United States Patent [19]

Kockerols et al.

[11] 4,290,153

[45] Sep. 22, 1981

[54] METHOD AND APPARATUS FOR GENERATING A CONTROLLED CURRENT FLOW AND WAVES IN A WATER POOL

[75] Inventors: Erhard Kockerols, Bad Soden; Albert Sagemüller, Gütersloh, both of Fed. Rep. of Germany

[73] Assignee: Thyssen Industrie AG

[21] Appl. No.: 30,940

[22] Filed: Apr. 17, 1979

[30] Foreign Application Priority Data

Apr. 18, 1978 [DE] Fed. Rep. of Germany ..... 2816756

[51] Int. Cl.[3] ..... A47K 3/10; E04H 3/18; E02B 3/00

[52] U.S. Cl. ..... 4/491; 137/392; 272/26; 405/79

[58] Field of Search ..... 4/172, 172.15, 172.16, 4/172.17, 173 R, 178, 180, 487, 491, 492, 494, 496, 541–543, 567–570; 68/133, 207; 405/79; 137/392; 272/26

[56] References Cited

U.S. PATENT DOCUMENTS

| | | | |
|---|---|---|---|
| 3,498,085 | 3/1970 | Czech | 68/207 X |
| 3,605,131 | 9/1971 | Brazel et al. | 4/172.16 |
| 3,789,612 | 2/1974 | Richard et al. | 4/172.16 X |
| 4,062,192 | 12/1977 | Brewer | 4/172.16 X |
| 4,169,293 | 10/1979 | Weaver | 4/180 X |

FOREIGN PATENT DOCUMENTS

| | | | |
|---|---|---|---|
| 1907278 | 8/1970 | Fed. Rep. of Germany | 405/79 |
| 2209507 | 9/1973 | Fed. Rep. of Germany | 4/172.16 |
| 106159 | 5/1917 | United Kingdom | 4/172.16 |

*Primary Examiner*—Stuart S. Levy
*Attorney, Agent, or Firm*—McGlew and Tuttle

[57] ABSTRACT

An apparatus for generating a control current flow in a pool, comprises, a continuously operable electric motor which has a rotatable drive shaft which is connected to an electrically operated clutch. A rotatable propeller drive shaft is disposed alongside the clutch and is engageable with the clutch upon actuation thereof to rotate a propeller affixed thereto to produce a current flow in the pool. The device includes means for sensing the level of the water and for operating the clutch either directly upon changes of level or after a time delay so that it selectively engages and disengages from the propeller drive shaft. The engagement for rotation of the propeller at selected intervals in accordance with the level of the pool produces a wave flow within a few minutes.

7 Claims, 1 Drawing Figure

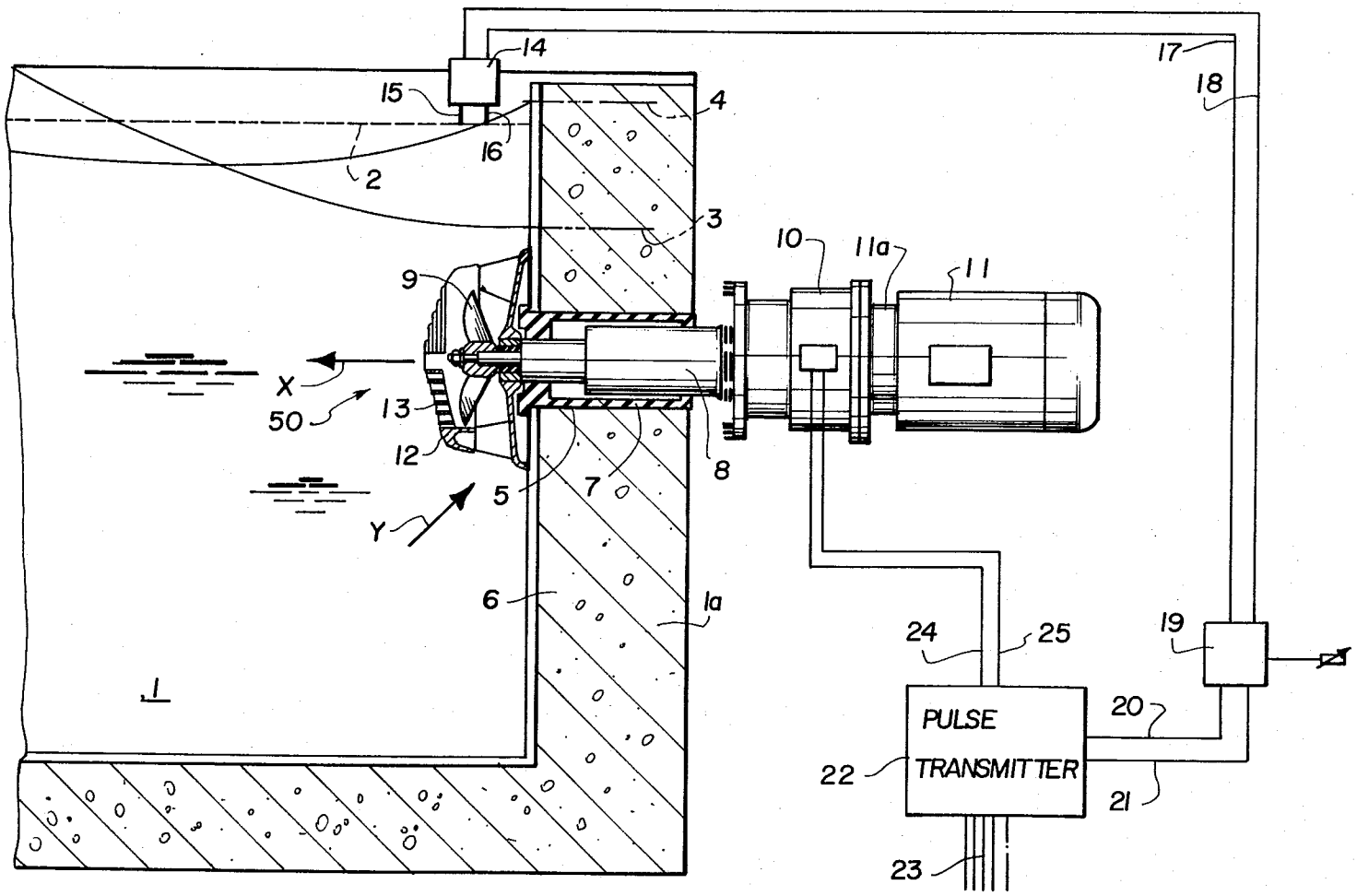
PULSE TRANSMITTER
1
1a
2
3
4
5
6
7
8
9
10
11
11a
12
13
14
15
16
17
18
19
20
21
22
23
24
25
50
X
Y

METHOD AND APPARATUS FOR GENERATING A CONTROLLED CURRENT FLOW AND WAVES IN A WATER POOL

FIELD AND BACKGROUND OF THE INVENTION

This invention relates to swimming pool apparatus in general and, in particular, to a new and useful device for producing a control current flow and wave action in a swimming pool and to a method of effecting such wave action.

DESCRIPTION OF THE PRIOR ART

The use of pivotable wings, plungers, piston pumps, or displacing devices, for example, ram plates to produce artificial waves are known from the prior art. The ram plate has a very low efficiency, that is, it uses high power consumption, since energy gets lost by the necessity of the water flow about the edges and also due to the splash at the impact on the water surface.

The use of a plunger, in view of its large mass, requires correspondingly large displacement forces and a correspondingly voluminous, rigid and expensive drive mechanism. Waves produced by means of pivotable wings are disadvantageous because the joints and stuffing boxes are immersed in water and large load variations must be taken into account if the wave produced behind the wing interferes unfavorably with the wave propagating forwardly into the pool. With the wave-producing devices which work on the piston principles, great mechanical losses occur and the pistons are, in addition, subjected to correspondingly strong wear.

In general, the wave-producing devices for swimming pools employed at the present time are in the nature of displacers, which are very expensive in construction and are therefore found only in swimming establishments in large cities. These devices are based on a displacement system and thus, they comprise piston-like displacement bodies which are reciprocated mechanically. The mentioned relatively poor efficiency and the large power supply required, are the most weighty disadvantages of such prior art devices.

Displacers of this kind which are provided in swimming pools in cities occupy entire parts of buildings and require special switching stations which also accommodate the large, expensive and very bulky drives. Because of the high capital investment, many communities and cities avoid the installation of such wave-producing devices. In private swimming pools, the installation of such devices cannot ordinarily be taken into account, not only because of budgetary considerations, but also for structural reasons. This also applies to subsequent installation of a wave-producing device. It is also known to use a propeller with fixed wings and a drive motor which is periodically reversed. Because of the high starting current required, however, there is a risk of burning through the installation and, accordingly, such designs have not been put into practice.

It has further been proposed to use a reversing gear of a type used in ships to change the direction or rotation of the drive motor of a propeller. In this case, a variable pitch propeller known per se in the ship building industry, has been proposed. Such a reversing gear is very expensive, however, and is therefore unsuitable, particularly for private use. There is frequently no space available to accommodate such a reversing gear and, in addition, the gear produces disturbing noises. Accordingly, such a solution is completely unacceptable for private use.

The writer who proposed this solution in an article of a technical periodical has overlooked the fact that, at the reversal of the gear, the propeller causes a suction intermittently, so that waves cannot be formed. If, in this connection, a variable pitch propeller is used in addition, the objection thereto is that such a propeller is very expensive and cannot be reversed intermittently with the required speed. Therefore, this proposal is misleading as to the use of a propeller in water or swimming pools, particularly for private use.

SUMMARY OF THE INVENTION

In accordance with the present invention, there is provided a rotatable propeller which is rotatably mounted in a sealed location on a wall of a swimming pool, for example, and which includes a drive shaft which is connectable to an electrically operated clutch driven by an electric motor which is advantageously set for continuous operation. With the inventive method and apparatus, the level of the water directly overlying the pump is measured or sensed and variations of the level are used to effect the engagement or disengagement of the clutch with the propeller drive shaft. The engagement of the clutch may be through a time delay and the control is such that after a few minutes of operation, a wave motion is produced in the pool by the engagement or disengagement.

The inventive solution of the present invention makes it possible to provide a wave-producing device not only in the initial designs of swimming pools, but also in already finished and operating water- or swimming pools. The invention preferably also provides a wave-producing device for private swimming pools which is simple in design, without incurring large expenses for its installation.

The inventive device for carrying out the control produces a broad countercurrent in the entire swimming pool and thus can produce conditions for any type of swimming. The swimming in countercurrents, for example, is ideal for competitive swimmers. The back stream in a swimming pool is particularly suitable for training children. In addition, any user of the swimming pool may choose the distance from the countercurrent producing device which best corresponds to his capabilities.

As compared to the conventional devices for producing countercurrents, the inventive bladed wheels or propellers used in accordance with the invention make it possible to produce a power which is a multiple of for instance four to five times stronger than the power obtainable with the conventional devices. In addition, such a countercurrent-producing device may also be employed for massage purposes.

Further, the inventive device may be controlled to produce waves of the desired height with a relatively small power even in large pools. If the swimming pools are extremely large, such as, for example, constructed or designed in swimming establishments or open-air swimming pools of large cities, if necessary, a plurality of inventive controls, each with at least one bladed wheel or propeller may be employed, with the water delivery of the propellers being rhythmically and intermittently interrupted or disturbed and then switched on again, or with the water delivery remaining undisturbed.

The application of the invention makes it possible to use the countercurrent-producing devices already provided in many pools, particularly private swimming pools, to produce waves in addition to the current flow. It has been found that, even in larger swimming pools, the desired waves may be produced within minutes, for example, within two minutes, and maintained during the predetermined time.

In contradistinction to the displacers of the prior art, the inventive device is particularly advantageous in that only small capital investment is necessary to produce the waves and the accommodation of the control parts does not require any particular structures, reconstructions in buildings or switching stations. By applying the teaching of the invention, many households, as well as communities and cities, will be able to equip swimming pools with a wave-producing device or to adapt the already installed countercurrent-producing devices to the production of waves by providing the inventive control. Since the wave action itself controls the electromagnetic clutch, the control is very simple and accurate. In all cases, the sensor for the pool surface level can be adjusted to the respective reference plane, even with a varying water level in the pool.

The electromagnetic clutch, for instance, a remote-controlled clutch, does not substantially enlarge the overall constructional dimensions of the device. In particular, no constructional changes are necessary in the swimming pool, for example, in the masonry. The electrically or electronically-operating sensor of the pool surface level is connected, through electrical lines, for example, to a pulse delay circuit and a pulse transmitter which may also be constructionally united with the pulse transmitter being connected to the power supply. The electrical lines may be concealed so that the outer aspect of an already installed device is not changed by adding the inventive control.

Due to the use of a pulse delay circuit with a pulse transmitter, a lead or a delay is obtained. This prevents an incoming wave from being immediately pushed away again and eliminates conditions under which, after a short starting time, only a stream is produced instead of forming waves. The inventive delay makes a maximum displacement of the water by the propeller or bladed wheel possible and produces high waves. For example, experience has shown that with only a 3 kw motor, desired waves may be generated in swimming pools having dimensions of $5\times10$ meters or $5\times8$ meters.

In all cases, it is possible to operate the clutch with a safe voltage, for example, of only 24 volts, so that no risk is run. Of course, many other local safety regulations may be observed during the installation and operation of the inventive control.

If a control according to the invention is used, a switching on or off takes place only if the wave-producing device is actually in operation, i.e., only when waves are to be produced. This prevents a switching on or off if the surface of the pool is disturbed by wind or by the users of the pool.

Similar advantages are also obtained with an embodiment of the invention in which the surface level of the pool is used as a control and the electrical or electronic sensor is adjusted in a particularly simple manner to a reference plane, that is, to the pool surface level at rest. An embodiment in which a timer or time delay is used for wave control is also particularly advantageous since, with that provision, an unintentional switching on or off of the wave-producing device is prevented if only small waves are produced in the pool by the user.

The device for carrying out the inventive method is particularly advantageous and compact. In addition, it makes possible a simple mounting since, for example, only a single bore through the masonry of a swimming pool is needed to equip the pool with the inventive device, either initially or even subsequently.

Accordingly, an object of the present invention is to provide an apparatus for generating a control current flow in a pool which comprises a continuously operable electric motor having a rotatable drive shaft which is connected to an electrically operated clutch and which is arranged alongside a rotatable propeller drive shaft carrying a propeller which is mounted for rotation in a pool so that the propeller produces a current flow and further including sensing means for sensing the level of the liquid overlying the propeller in the pool and which is connected to the clutch so that the clutch is operated in accordance with the level sensed to selectively rotate and disengage the propeller.

A further object of the invention is to provide a method of forming waves in a pool and the like, which comprises, positioning a rotatable propeller below the level of the liquid in the pool, connecting a continuously operable electric drive motor through a clutch to the propeller so as to rotate the propeller thereby, continuously measuring the level of the liquid overlying the propeller in the pool and regulating the clutch so as to periodically disengage the clutch from the propeller and to reengage the propeller subsequently in a timed engagement and disengagement sequence so as to produce a wave motion within the pool.

Another object of the present invention is to provide a device for generating a control current flow in a pool which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawing and descriptive matter in which a preferred embodiment of the invention is illustrated.

BRIEF DESCRIPTION OF THE DRAWING

The only FIGURE of the drawing is a schematic, partial sectional view of a swimming pool having a device for generating a control current flow therein, constructed in accordance with the invention.

DESCRIPTION OF THE PREFERRED EMBODIMENT

Referring to the drawing in particular, the invention embodied therein, comprises, an apparatus for generating a control current flow in a swimming pool, generally designated 1, which includes a continuously operable electric motor 11 having a rotatable motor shaft 11*a* which is connected to an electrically operated clutch 10.

In accordance with the invention, a rotatable propeller 9 is mounted on its propeller shaft 8 in a sealing sleeve 7 so that the propeller projects into the pool 1 below the liquid level 2 thereof. Rotation of the pump 9 when its drive shaft 8 is connected to an electromagnetic clutch 10 produces a current flow in the pool which varies the level of the liquid and this variation of the level is measured by sensor means 14 which includes a pulse delay 19 and a pulse transmitter 22 which are connected to the electromagnetic clutch.

With the inventive method, the level is sensed to operate the clutch 10 so as to periodically discontinue the drive of propeller 9 and to subsequently continue its drive and to thereby produce a control current flow and a wave-like action.

The drawing shows a swimming pool 1 filled with water. The surface level of the pool while the wave-producing device is not operated is (calm surface level) indicated in a dotted line at 2. The curved line 3 indicates a wave trough in the zone of the wave producing device, generally designated 50, while the line 4 indicates a wave crest in the zone of the wave-producing device.

In the embodiment of the invention, a sealing device 7 is passed through a hole 5 provided in a vertically wall 1*a* of swimming pool 1 and a propeller drive shaft 8 of a bladed wheel or propeller 9 extends coaxially through the hole, with the propeller being secured to driving shaft 8 in an overhung position. Bladed wheel 9 may be designed in a manner known per se for so-called countercurrent systems, and it produces a flat directional flow in the direction indicated by the arrow X. Such bladed wheels 9 are sometimes called turboscrews.

As a rule, the hole 5 in the wall will not be centrical relative to the longitudinal axis of the swimming pool and, thus, it will not be in the center line of the pool but is placed laterally thereof at a certain distance from the pool rim. In private swimming pools, it is normally sufficient to drive a hole through the wall having a diameter of 9 centimeters, for example, while the lateral distance from the pool rim of the drive shaft 8 may be about 700 mm, for example. The axis of rotation of bladed wheel or propeller 9 extends at a certain distance below the pool water surface level 2. This vertical distance may be, for example, 360 mm.

In the embodiment shown, an electromagnetic clutch 10 which is coaxial with the propeller driving shaft 8 is provided and associated with a rotatable drive shaft 11*a* of an electric motor 11 which is also coaxial therewith. The design of clutch 10 is such that it permits a relatively frequent engagement and disengagement with the drive motor 11 continuously running in one direction. Clutch 10 may be designed, for example, as a multiple disc clutch.

As further shown in the drawing, bladed wheel 9 is equipped in the flow direction X with a guide basket 12 having a plurality of guide elements 13 of the kind of blades or wings whose longitudinal axes extend in the flow direction X. A plurality of slot-shaped flow openings is provided between guide elements 13, and their cross-sectional areas of passage may be varied by pivoting or swiveling guide elements 13 by means which are not shown in the drawing. Also, only a part of the guide elements 13 may be adjusted in the flow direction X by pivoting.

Propeller 9 rotates with a relatively small or very small play in the associated housing. The water from pool 11 is taken in laterally through a plurality of suction openings provided at the periphery and uniformly spaced, thus, for example, in the direction indicated by the arrow y.

A pool surface level sensor is shown at 14 and is equipped in the embodiment shown with suitable electrical sensors, for example, electrodes 15 and 16 which are in contact with or slightly dipped into the pool surface level 2 at rest. Electrical lines are shown at 17 and 18 through which the surface level sensor 14 is electrically connected to a suitable pulse delay circuit 19 which, in turn, is electrically connected through lines 20 and 21 to a pulse transmitter 22. Pulse transmitter 22 is connected through lines 23 to the power supply and through lines 24 and 25 to the electromagnetic clutch 10.

The device operates as follows:

The device is connected to the power supply 23 and is rendered operative by a main switch (not shown). In the rest position, sensors 15 and 16 are in contact with the pool surface level 2 or slightly dipped into the surface, whereby, they release an electric pulse. This pulse is supplied through pulse delay circuit 9 and pulse transmitter 22 to electromagnetic clutch 10, as a switching pulse and in a manner such that the clutch is engaged. Thereby, drive motor 11, which has been switched on in advance and runs continuously during the use of the device, supplies power through clutch 10 to drive shaft 8 by which the bladed wheel 9 is driven. Bladed wheel 9 takes in water by suction in the direction Y and displaces it in the direction X as a flat stream into swimming pool 1. A certain flow is thereby produced in pool 1.

Due to the suction produced by the wheel, surface level 2 of the pool is lowered so that electrodes 15 and 16 are exposed. This causes a corresponding switching pulse delivered to clutch 10 which is disengaged while drive motor 11 continues running. Consequently, bladed wheel 9 is stopped. The water flowing back again contacts electrodes 15 and 16 and causes an engaging pulse to be delivered to clutch 10 so that bladed wheel 9 is again set in rotation. After a short time, waves are produced in pool 1 in this manner. Bladed wheel 9 is engaged and disengaged in the rhythm of the waves so that a small power supply for bladed wheel 9 is sufficient to produce a necessary height of the wave.

The wave-producing device of the invention may, of course, be used without any difficulties as a usual countercurrent-producing device.

While a specific embodiment of the invention has been shown and described in detail to illustrate the application of the principles of the invention, it will be understood that the invention may be embodied otherwise without departing from such principles.

What is claimed is:

1. An apparatus for generating a control current flow in a pool, comprising, a continuously operable electric motor having a rotatable drive shaft, an electrically operated clutch connected to said drive shaft, a rotatable propeller drive shaft disposed adjacent said clutch and being engageable with said clutch upon actuation of said clutch, a propeller affixed to said drive shaft for rotation therewith, mounting means rotatably supporting said drive shaft so that said propeller is disposed in said pool below the water level thereof, sensor means for sensing variations in the water level of the pool connected to said clutch for electrically actuating said clutch to selectively engage said clutch with said propeller drive shaft to drive said propeller to produce a current flow in said pool and to subsequently disengage said clutch from said drive shaft, said sensor means including a sensor having electrodes disposed substantially at the level of the surface of the liquid in the pool, a pulse delay connected to said sensor and a pulse transmitter connected between said pulse delay and said clutch for actuating said clutch after a delay.

2. An apparatus for generating a control current flow in the water of a pool having a calm surface level to make waves comprising, a continuously operable electric motor having a rotatable drive shaft, a clutch connected to said drive shaft, a rotatable propeller drive shaft disposed adjacent said clutch and being engageable with said clutch upon actuation of said clutch, a propeller affixed to said drive shaft for rotation therewith, mounting means rotatably supporting said drive shaft so that said propeller is disposed in said pool below the calm surface level of the water in the pool, sensor means for sensing the calm surface level of the water in the pool, a wave crest in the pool and a lower level which indicates the presence of a wave trough, said sensing means connected to said clutch for actuating said clutch to selectively engage said clutch with said propeller drive shaft to drive said propeller to produce a current flow in said pool with the presence of the calm surface level and a wave crest and to subsequently disengage said clutch from said drive shaft in the presence of wave troughs, in the area of the sensor means of the wave generating apparatus.

3. An apparatus, as claimed in claim 1, wherein said sensor means measures the mean surface level in said pool and includes a pulse transmitter actuated thereby connected to said clutch.

4. An apparatus, as claimed in claim 2, wherein said sensor means includes a delay and a pulse transmitter connected to said clutch, said sensor means acting upon changes of level to actuate said delay which, after a time period, actuates said clutch.

5. An apparatus, as claimed in claim 2, wherein said electric motor is continuously rotated in a single direction, said clutch comprising a multiple disc clutch connected between said drive motor shaft and said propeller drive shaft.

6. An apparatus, as claimed in claim 2, wherein said mounting means comprises a sealing sleeve adapted to be mounted in a wall of the swimming pool and including guide means associated with said propeller for guiding the liquid in the pool to an inlet to said propeller and discharge in a direction ahead of said propeller.

7. A method for generating a control current in water at a calm level in a pool to make waves, using a rotatable propeller mounted in the pool below the calm water level and having a rotatable propeller shaft which is connectable to an electromagnetic clutch driven by an electric motor, a sensor having electrodes disposed substantially at the level of the surface of the liquid in the pool and a pulse transmitter for actuating said clutch in response to the readings of the sensor, comprising, continuously running the electric motor while sensing an actual level of the liquid above the propeller in the pool and selectively actuating the clutch to engage the drive shaft of the propeller when the electrodes of the sensor indicate that the water level is at and above the calm level and for discontinuing the propeller drive when the electrodes of the sensor indicate that the water level has fallen below the calm level, the clutch being actuated by the pulse transmitter to rotate the propeller when the liquid is at and above the calm level and said clutch is deactuated by said pulse transmitter to stop the propeller when the liquid is below the calm level which indicates a wave trough in the area of the pool sensor.

* * * * *